US005818165A

United States Patent [19]

Malhi

[11] Patent Number: 5,818,165

[45] Date of Patent: Oct. 6, 1998

[54] FLEXIBLE FED DISPLAY

[75] Inventor: Satwinder Malhi, Garland, Tex.

[73] Assignee: Texas Instruments Incorporated, Dallas, Tex.

[21] Appl. No.: 548,971

[22] Filed: Oct. 27, 1995

[51] Int. Cl.[6] ..... H01J 1/30

[52] U.S. Cl. ..... 313/495; 313/496

[58] Field of Search ..... 313/495, 496, 313/309, 336, 351

[56] References Cited

U.S. PATENT DOCUMENTS

| | | | |
|---|---|---|---|
| 3,755,704 | 8/1973 | Spindt et al. | 313/309 |
| 3,812,559 | 5/1974 | Spindt et al. | 29/25.18 |
| 4,857,161 | 8/1989 | Borel et al. | 204/192.26 |
| 4,857,799 | 8/1989 | Spindt et al. | 313/495 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |

*Primary Examiner*—Sandra L. O'Shea
*Assistant Examiner*—Vip Patel
*Attorney, Agent, or Firm*—Christopher L. Maginniss; W. James Brady; Richard L. Donaldson

[57] ABSTRACT

An FED display (10) is provided which is formed from flexible materials. The flexible FED display (10) includes an anode element (12) having a face sheet layer (18) formed from a first layer of flexible insulating substrate material. A cathode element (14) is attached to the anode element (12). The cathode element (14) includes a backing sheet layer (26) formed from a second layer of flexible insulating substrate material (40).

14 Claims, 4 Drawing Sheets

FLEXIBLE FED DISPLAY

TECHNICAL FIELD OF THE INVENTION

This invention relates generally to field emission device (FED) displays, and more particularly, to flexible FED displays.

BACKGROUND OF THE INVENTION

Previously developed electronic visual displays have taken many forms. Examples of such displays are cathode ray tubes (CRTs), liquid crystal displays (LCDs), and more recently, field emission device (FED) displays. An example of an existing FED display is disclosed in U.S. Pat. No. 5,194,780 issued to Meyer, the text of which is incorporated by reference herein. Because FED displays are relatively thin (i.e., typically less than one inch thick), they are suitable for applications that require compactness and portability, such as a display for a notebook computer.

The compactness and portability of previous FED displays, however, have been limited primarily by the viewing area required for the display. Generally, a display having a large viewing area can present more information than a smaller area display. The size of the display is thus an important operational parameter, which loses its importance when the display is inactive and no information is being shown. Previous FED displays were constructed from rigid materials, so their viewing areas were fixed once the displays were fabricated.

SUMMARY OF THE INVENTION

Accordingly, there is a need for a flexible FED display that can be reduced in size when the display is inactive.

In accordance with the present invention, an FED display is provided which is constructed from flexible materials. The flexible FED display includes an anode element having a face sheet layer formed from a first layer of flexible insulating substrate material. A cathode element is attached to the anode element. The cathode element includes a backing sheet layer formed from a second layer of flexible insulating substrate material.

An important technical advantage of the present invention is that the flexible FED display can be rolled up or folded when the display is inactive, which increases the display's compactness and portability.

Another important technical advantage of the present invention is that individual sections of the foldable FED display can be tested before the display is fully assembled, which increases production yields for the displays.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–7 of the drawings, like numerals being used for like and corresponding parts of the various drawings.

Figure 1:
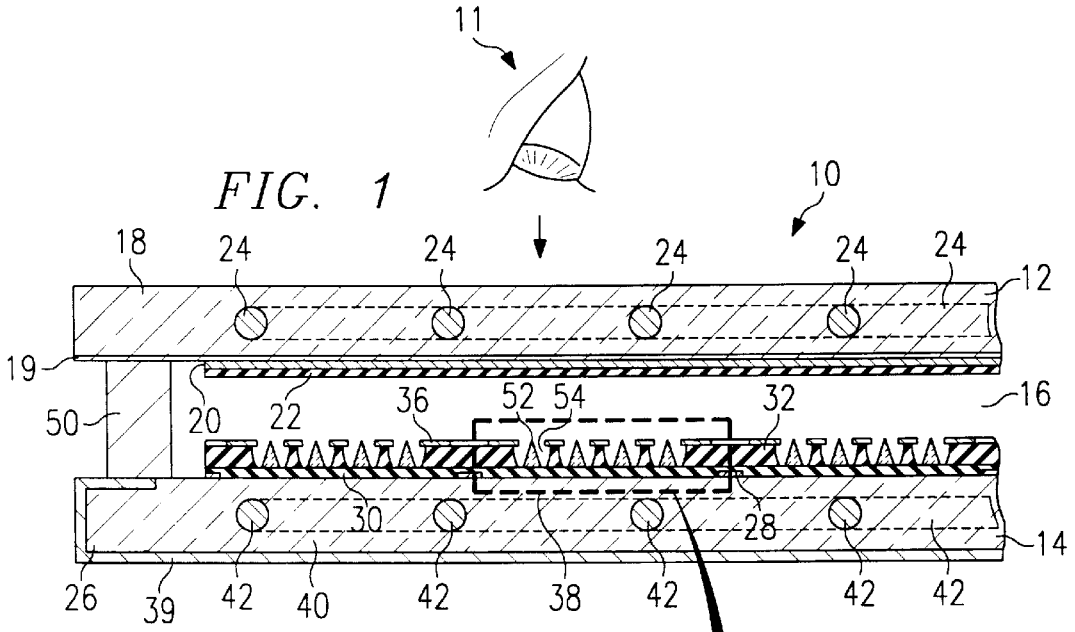
FIG. 1 is a cross-sectional view of a flexible FED display structured according to a preferred embodiment of the present invention.

FIG. 1 is a cross-sectional view of a flexible FED display structured according to a preferred embodiment of the present invention. It should be noted that the layers depicted in FIG. 1 are not drawn to scale. Essentially, the materials used to form the present display are flexible so that the display can be rolled up into a more compact size.

Referring to FIG. 1, flexible display 10 includes an anode element 12 which is arranged in parallel to a cathode element 14. Anode element 12 and cathode element 14 are separated by a predetermined distance or gap 16. The volume defined by gap 16 and the sealed peripheral edges of display 10 (not explicitly shown) preferably maintains a negative pressure or vacuum. A visual image is displayed when electrons emitted by cathode element 14 traverse gap 16 and impinge on anode element 12, which causes the anode element to luminesce or glow with a predetermined pattern.

Anode element 12 is constructed from multiple layers of material, which include a face sheet layer 18, a vacuum seal layer 19, a conductive layer 20, and a luminescent layer 22. Face sheet layer 18, vacuum seal layer 19, and conductive layer 20 are constructed of transparent materials so that a viewer 11 can view the image being displayed.

Face sheet layer 18 is preferably constructed from a flexible insulating substrate material, such as an elastomer, which is strong enough to maintain a vacuum. For example, face sheet layer 18 can be formed from a polyimide such as Kapton. A composite matrix 24 is embedded in face sheet layer 18. Composite matrix 24 can be formed from a flexible metal material or glass fiber material, such as Miramar produced by Owens Corning. Composite matrix 24 may be structured as a mesh of interconnecting rows and columns of fiber. Accordingly, referring to FIG. 1, composite matrix 24 includes a plurality of fibers that are perpendicular to this cross-sectional view of flexible display 10. Composite matrix 24 may also include a plurality of fibers that intersect the perpendicular fibers. Because these intersecting fibers are embedded in face sheet layer 18 and are parallel to the cross-sectional view, they are not visible in FIG. 1. Composite matrix 24 functions to prevent face sheet layer 18 from stretching out of shape or being torn when display 10 is rolled or folded.

Vacuum seal layer 19 is deposited on the interior surface of face sheet layer 18. The interior surface of face sheet layer 18 faces the surface of cathode element 14. The exterior surface of face sheet layer 18 is directed toward the viewer 11. Vacuum seal layer 19 can be constructed from a thin and flexible material such as silicon dioxide ($SiO_2$), silicon nitride ($Si_3N_4$), or silicon carbide (SiC), which is impervious to gases, and therefore strong enough to maintain a vacuum.

Conductive layer 20 is formed on the surface of vacuum seal layer 19 as one continuous layer, which is preferably about 1500 Å thick. Conductive layer 20 is made of an electrically conductive material, such as indium tin oxide. In a different aspect of the invention, conductive layer 20 can be formed across the surface of vacuum seal layer 19 as a plurality of conductive bands, using a photolithography and etching process.

Luminescent layer 22 is formed on the inner surface of conductive layer 20. The inner surface of layer 20 is directly opposite the inner surface of cathode element 14, but the two surfaces are separated by gap 16. Luminescent layer 22 is constructed from a luminescent material, such as, for example, phosphorous (P), which emits light when it is bombarded by electrons. Depending on the specific arrangement of conductive layer 20 (continuous structure or plurality of conductive bands), luminescent layer 22 can be formed either as a continuous layer over a continuous conductive layer 20 or as a plurality of stripes of luminescent materials disposed on respective conductive bands. In one aspect of the invention, flexible display 10 can be a trichromatic (three) color display. Luminescent layer 22 is thus composed of a first material that luminesces red, a second material that luminesces green, and a third material that luminesces blue. If conductive bands are used, the stripes for the respective colors are electrically connected together.

Still referring to FIG. 1, cathode element 14 is constructed from multiple layers of material, which include a backing sheet layer 26, a plurality of conductors 28, a resistive layer 30, an insulating layer 32, and a gate electrode layer 36. A plurality of microtip clusters 38 is formed within insulating layer 32 and gate electrode layer 36.

Backing sheet layer 26 may be constructed from a flexible metal film layer 39 laminated to a flexible insulating substrate layer 40. Flexible metal film layer 39 and flexible insulating substrate layer 40 are each strong enough to maintain a vacuum in gap 16. Flexible metal film layer 39 can be made, for example, from aluminum (Al). Flexible insulating substrate layer 40 is preferably constructed from a polyimide, such as Kapton.

A composite matrix 42, which is constructed from flexible glass or metal fibers (e.g., Miramar), can be embedded in insulating substrate layer 40 to prevent backing sheet layer 26 from stretching and tearing. Composite matrix 42 may be structured as a mesh of interconnecting rows and columns of fiber. The embodiment shown in FIG. 1 has been described with both a composite matrix 24 in face sheet layer 18 and a composite matrix 42 in backing sheet layer 26. However, a single composite matrix also can be formed either in face sheet layer 18 or backing sheet layer 26. Alternatively, display 10 can be constructed without a composite matrix.

A plurality of conductors 28 are formed on an interior surface of backing sheet layer 26. The interior surface of backing sheet layer 26 faces the interior surface of anode element 12. Conductors 28 can be structured as two sets of mutually parallel strips that orthogonally intersect. To form conductors 28, a conductive material, such as, for example, niobium (Nb) is deposited on backing sheet layer 26 to form a thin coating that is about 2,000 Å thick. The conductive coating is then photolithographed and etched to produce a conductive mesh structure. Preferably, each of the plurality of conductors 28 is 2–3 $\mu$m wide and separated from its adjacent conductors by a distance of 25–30 $\mu$m. The adjacent conductors 28 run parallel to one another.

Resistive layer 30 is formed over conductors 28 and backing sheet layer 26. Resistive layer 30 is constructed from a resistive material, such as silicon (Si), which can be sputtered or chemical vapor deposited on backing sheet layer 26 and conductors 28. Preferably, resistive layer 30 is about 10,000–12,000 Å thick.

Insulating layer 32 is formed on the surface of resistive layer 30 as a continuous layer. Insulating layer 32, made from an insulating material such as $SiO_2$, may be deposited on resistive layer 30 by a chemical vapor deposition process. Insulating layer 32 may have a thickness of 1.0–1.2 $\mu$m.

Gate electrode layer 36 is deposited on the surface of insulating layer 32 in opposition to the interior surface of anode element 12. Gate electrode layer 36 may be formed by sputtering or evaporation onto the insulating layer. Gate electrode layer 36, made of a conductive material, such as Nb, preferably has a thickness of about 2,000 Å.

Microtip clusters 38 are formed in insulating layer 32 and gate electrode layer 36. The structure and function of microtip clusters 38 will be described in more detail below with respect to FIG. 2.

Gap 16 separates anode element 12 from cathode element 14. In order for flexible display 10 to function optimally, gap 16 is preferably 200 $\mu$m wide. Thus, during the fabrication of display 10, a non-conductive mesh (not explicitly shown), having a thickness of just less than 200 $\mu$m, may be inserted within gap 16 in order to maintain the 200 $\mu$m spacing between the anode and cathode elements. The non-conductive mesh may be formed of a flexible insulating glass fiber material, such as Miramar, or a polymer.

A flexible frit 50 is disposed between the peripheral edges of anode element 12 and cathode element 14. Flexible frit 50 may be made of glass fibers bound together by an epoxy composition. The epoxy composition has a lower melting point than the conductive mesh inserted within gap 16. In order to maintain a vacuum in gap 16 and to seal the separate anode and cathode elements together, the two elements are annealed together in a furnace. The annealing process occurs at a temperature high enough to melt the epoxy of flexible frit 50, but not the non-conductive mesh. Metal film layer 39 of backing layer 24 is then wrapped over the edge of insulating substrate 40 to provide a vacuum seal with flexible frit 50. The combination of the flexible frit 50, metal film layer 39, and vacuum seal layer 19 disposed completely around the periphery of flexible display 10 functions to maintain the vacuum or negative pressure in gap 16.

Figure 2:
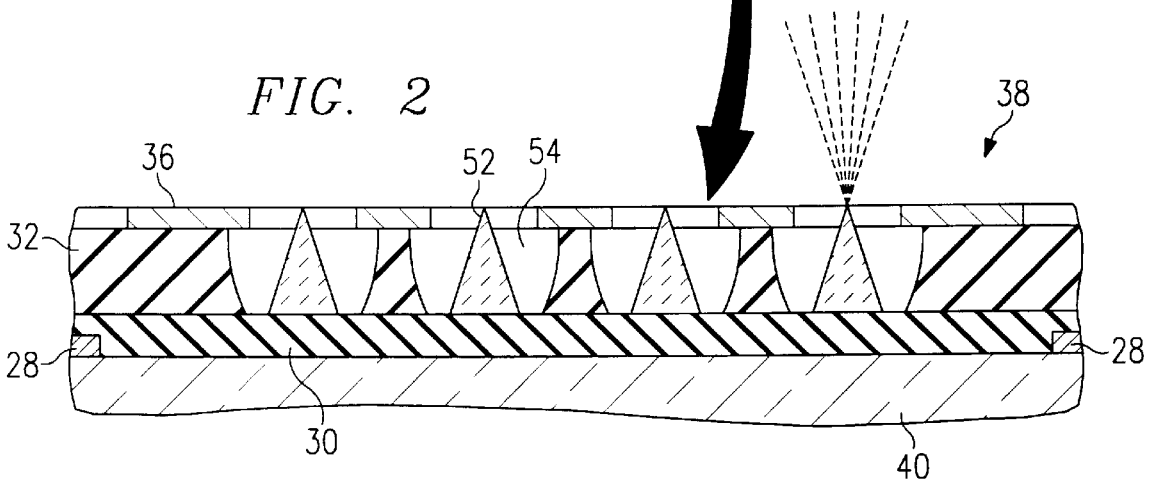
FIG. 2 is an exploded cross-sectional view of microtip cluster 38 shown in FIG. 1.

FIG. 2 is an exploded cross-sectional view of microtip cluster 38 shown in FIG. 1. For clarity, the layers and elements depicted in FIG. 2 are not drawn to scale. Microtip cluster 38 is structured from a plurality of cone-shaped microtips 52 formed within cavities 54. Each microtip 52 functions to emit electrons directed from its apex. The microtips extend through insulating layer 32 and gate electrode layer 36. Microtips 52 are made of a conductive material, such as molybdenum (Mo), that emits electrons when excited. The height of microtips 52 and the thicknesses of gate electrode layer 36 and insulating layer 32 are formed so that the apex of each microtip is substantially even with the interior surface of gate electrode layer 36.

Microtips 52 can be formed as follows. Gate electrode layer 36 is masked and etched to define a plurality of aperture arrays. Each array may be structured as an n×n (e.g., 4×4) or n×m (e.g., 4×5) arrangement of apertures. The apertures preferably have diameters in the range of 1.0–1.4 $\mu$m. A plurality of cavities 54, concentrically aligned with the apertures in gate electrode layer 36, are formed by etching insulating layer 32. A lift-off layer of material, such as nickel, may be deposited by an electron beam deposition process over gate electrode layer 36 to form a sacrificial lift-off layer. The electron beam is preferably directed at an angle to the surface of gate electrode layer 36 so that the lift-off layer of material is deposited on the circumferential walls of the apertures in gate electrode layer 36. A conductive tip forming material, such as molybdenum, is deposited within each cavity 54 by directing a beam of electrons substantially normal to the apertures. The deposition of conductive tip forming material forms microtips 52 in respective concentric alignment within cavities 54. Thereafter, a superfluous tip forming material that has been deposited over the sacrificial lift-off layer is removed together with the lift-off layer to form the microtip.

Figure 3:
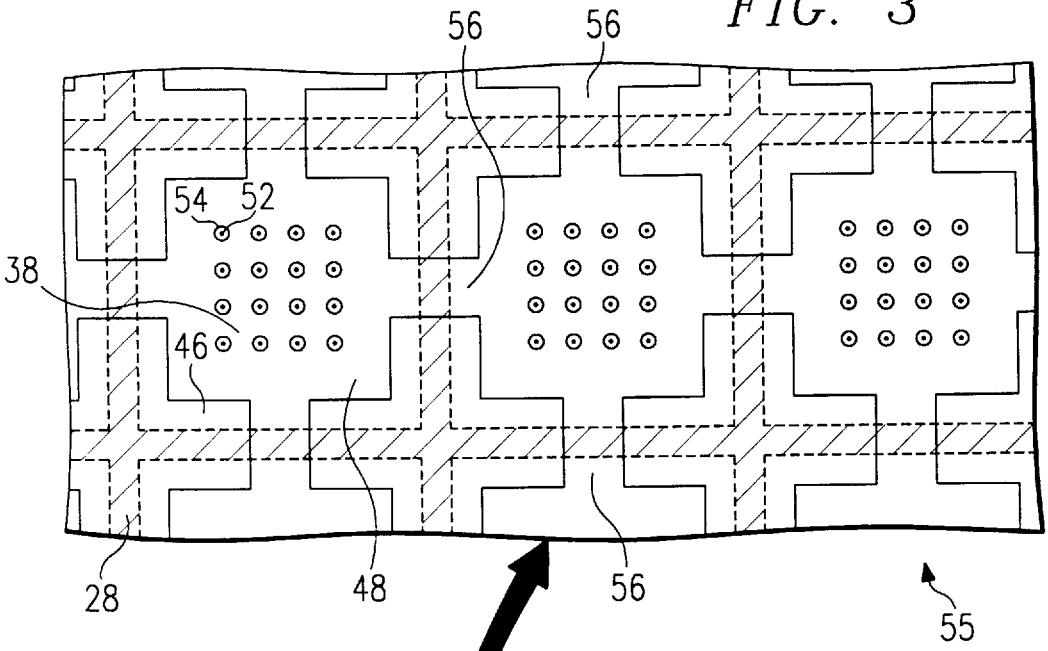
FIG. 3 is an exploded top view illustrating the arrangement of a plurality of microtip clusters.

FIG. 3 is a top view of a plurality 55 of microtip clusters 38. Microtip clusters 38 may be formed as n×m cellular arrays of microtips 52. For example, as shown in FIG. 3, each microtip cluster 38 is structured as a 4×4 array of microtips 52.

Each microtip cluster 38 is formed in a corresponding pad or aperture island 48 of gate electrode layer 36. Each pad 48 is located over a mesh spacing 46 defined by the orthogonal intersection of the two sets of mutually parallel conductors 28, discussed above with respect to FIG. 1. Because conductors 28 are disposed a number of layers beneath gate electrode layer 36, conductors 28 are shown by dotted lines.

Pads 48 form a part of gate electrode layer 36. Each pad 48 is disposed over a separate mesh spacing 46 (outlined in dotted lines). As explained below, a plurality of bridges 56 electrically interconnect certain pads 48. To form pads 48 and bridges 56, a conductive material, such as Nb, is deposited as a continuous layer over insulating layer 32. This continuous layer of conductive material is then masked and etched. Pads 48 may be structured as 15 $\mu$m squares. Bridges 56 preferably have a width of about 2–4 $\mu$m. At the same time that pads 48 and bridges 56 are formed, cross-shaped areas are created. These cross-shaped areas, located over the points of orthogonal intersection between conductors 28 (shown in dotted lines), expose sections of insulating layer 32 to the vacuum or negative pressure in gap 16.

Figure 4:
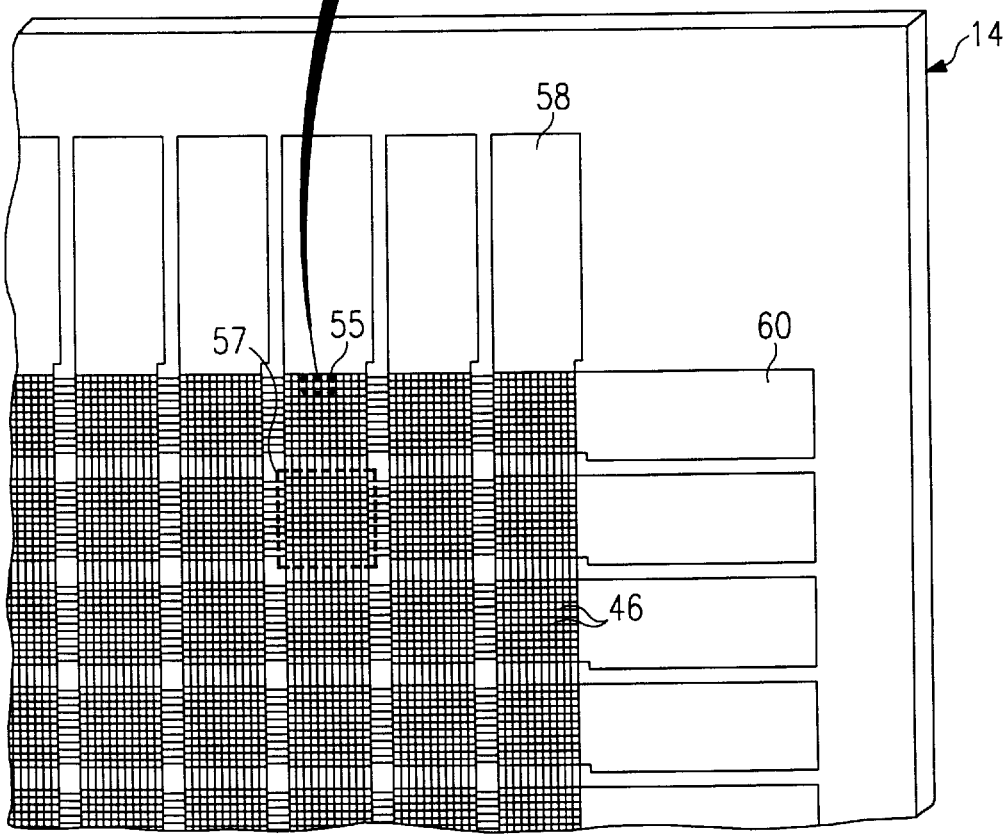
FIG. 4 is a macroscopic top view of column stripes and row cross-stripes in a display that define a pixel.

FIG. 4 illustrates a plurality of image pixels 57 on cathode element 14. Image pixels 57 are addressed by a column-row arrangement. More particularly, cathode element 14 includes a plurality of column stripes 58 and a plurality of row cross-stripes 60.

Column stripes 58 are mutually parallel and individually addressable. Each column stripe 58 includes a plurality of conductors 28. Furthermore, each column stripe 58 defines a column of pixels 57 extending across backing sheet layer 26. Each column stripe 58 may have a width of 300–400 $\mu$m and be spaced apart from adjacent column stripes 58 by 50 $\mu$m.

Row cross-stripes 60 are mutually parallel, individually addressable. The row cross-stripes are orthogonal to and electrically isolated from column stripes 58. Each row cross-stripe 60 includes a plurality of pads 48 electrically connected by bridges 56 of gate electrode layer 36. It should be noted that only those pads 48 of the same row cross-stripe 60 are joined by bridges 56. Each row cross-stripe 60 defines a full row of pixels 57 extending across backing sheet layer 26 and is electrically isolated from column stripes 58.

A pixel 57 is defined by the intersection of a column stripe 58 and a row cross-stripe 60. Each pixel 57 is structured as an i×i (e.g., 10×10) or an i×j (e.g., 11×10) array of mesh spacings 46. For example, the plurality of microtip clusters 55 shown in FIG. 3 is only a relatively small number of the microtip clusters 38 contained in a single image pixel 57. Furthermore, because each mesh spacing 46 is associated with a separate microtip cluster 38 (shown in FIG. 3), then each pixel 57 is structured as an i×j array of microtip clusters 38.

In operation, flexible display 10 is "flattened" to provide an operable display when the flexible display is active. An image may then be displayed on flexible display 10. The dimensions of the flattened display depend upon the end application of the display. For example, if flexible display 10 is to be utilized in a notebook computer, the length of the display can be twelve inches and the width can be ten inches. On the other hand, if flexible display 10 is to be utilized in a wrist-mounted device, the length of the display can be three inches and the width one inch.

When flexible display 10 is inoperative (not in use), it may be rolled up or folded into a more compact size. This compactness increases not only the portability of the flexible display 10, but also the portability of the device into which the display is incorporated.

FIGS. 5A–5D illustrate foldable displays 110*a* and 110*b* structured according to a second embodiment of the present invention. Each of foldable display 110*a* and foldable display 110*b* is constructed as a plurality of rigid sections joined by flexible materials. The formation and elements of foldable displays 110*a* and 110*b* are virtually identical to the formation and elements of flexible display 10 (FIGS. 1–4), except for the features that allow displays 110*a* and 110*b* to be foldable as opposed to flexible. Consequently, the following description for foldable displays 110*a* and 110*b* focuses mainly upon those features of foldable displays 110*a* and 110*b* that are not included in flexible display 10.

Figure 5A:
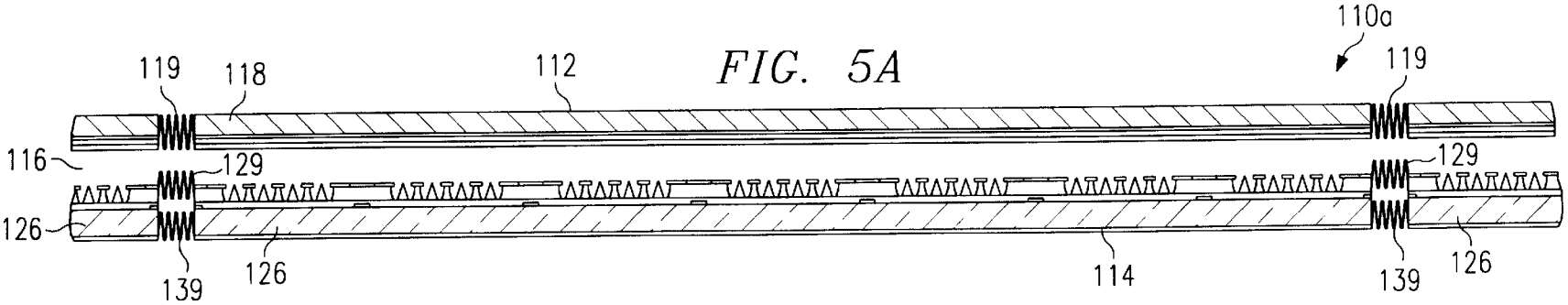
FIGS. 5A–5D are cross-sectional views of a foldable FED display structured according to a second embodiment of the present invention.

FIG. 5A is a cross-sectional view of foldable display 110*a* in an extended or unfolded position. Foldable display 110*a* includes an anode element 112, a cathode element 114, and a gap 116.

Anode element 112 is structured as a plurality of clear rigid plates 118 connected by a flexible material 119. Clear rigid plates 118 may be formed from an insulating substrate material, such as glass or polymer material. Flexible material 119 may be formed from a flexible and resilient elastomer material, such as a polymer film. Preferably, flexible material 119 is structured in multiple folds between clear rigid plates 118.

Cathode element 114 is constructed with a plurality of rigid plates 126 joined by both a flexible conductive layer 129 and a flexible film layer 139. Rigid plates 126 are made of an insulating substrate material, such as a glass material or rigid polymer.

Still referring to FIG. 5A, flexible conductive layer 129 may be structured as multiple folds of material disposed between adjacent rigid plates 126. Flexible conductive layer 129 electrically connects the conductors 28 (not explicitly shown) of adjacent plates 126. Flexible conductive layer 129 also connects the gate electrode layers 36 (not explicitly shown) of adjacent plates 126. It should be understood, however, that the connections between the adjacent conductors 28 are electrically isolated from the connections between the adjacent gate electrode layers 36 on flexible conductive layer 129. Flexible conductive layer 129 is made from a flexible conductive material, such as a metal foil material. For example, flexible conductive layer 129 may be structured from an aluminum, titanium, or tantalum foil.

Flexible film 139 is attached to adjacent rigid plates 126. Preferably, flexible film 139 is structured as a single sheet of material laminated to each of the rigid plates. Multiple folds of flexible film 139 may be provided between adjacent rigids plates 126. Flexible film 139 is a strong enough material to withstand repeated folding and unfolding. Flexible film 139 may be formed from a metal foil material.

Figure 5B:
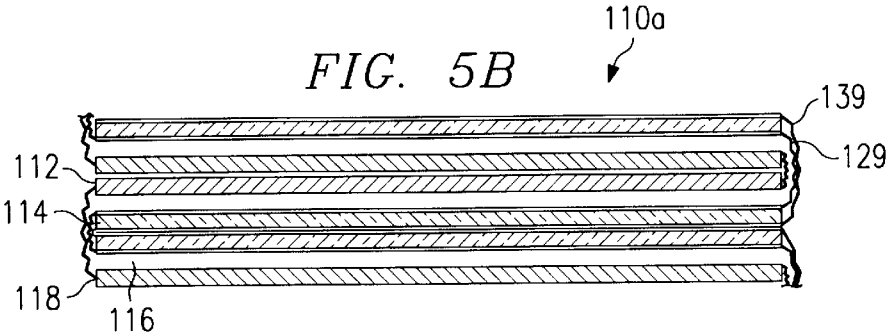

FIG. 5B illustrates foldable display 110*a* in a folded position. For clarity, some of the layers of anode element 112 and cathode element 114 are not shown. Flexible material 119 of anode element 112 is folded between clear rigid plates 118 without tearing. Likewise, sufficient amounts of flexible conductive layer 129 and flexible film 139 are provided between each rigid plate 126 of cathode element 114 so that flexible conductive layer 129 and flexible film 139 are not torn when foldable display 110*a* is folded.

In operation, and similar to flexible display 10, foldable display 110*a* can be flattened to provide an active viewing area when the display is operative. A foldable display 110*a* which is required to display a large amount of information can be relatively large. On the other hand, a foldable display 110*a* which is required to display only a small amount of information can be relatively small.

When foldable display 110*a* is inactive (not in use), it can be folded into a more compact size. In operation, and similar to flexible display 10, foldable display 110*a* can be flattened to provide an active viewing area when the display is operative. A foldable display 110*a* which is required to display a large amount of information can be relatively large. On the other hand, a foldable display 110*a* which is required to display only a small amount of information can be relatively small.

When foldable display 110*a* is inactive (not in use), it can be folded into a more compact size. Clear rigid plates 118 and rigid plates 126 are not required to be flexible and resilient because foldable display 110*a* is folded in flat sections. The dimensions of clear rigid plates 118 and rigid plates 126 dictate just how small and compact foldable display 110*a* can be made. For a given active display area, foldable display 110*a* can be made smaller and more compact when it is not in use, by using a larger number of relatively small rigid plates 118 and 126. Moreover, if clear rigid plates 118 and rigid plates 126 are formed in narrow enough strips, foldable display 110*a* can also be rolled up similar to flexible display 10.

Figure 5D:
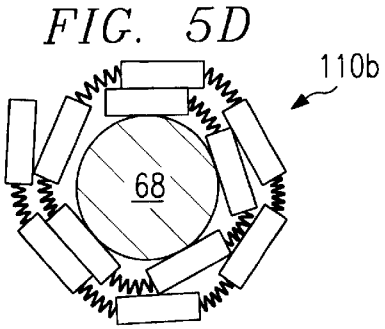
Figure 5C:
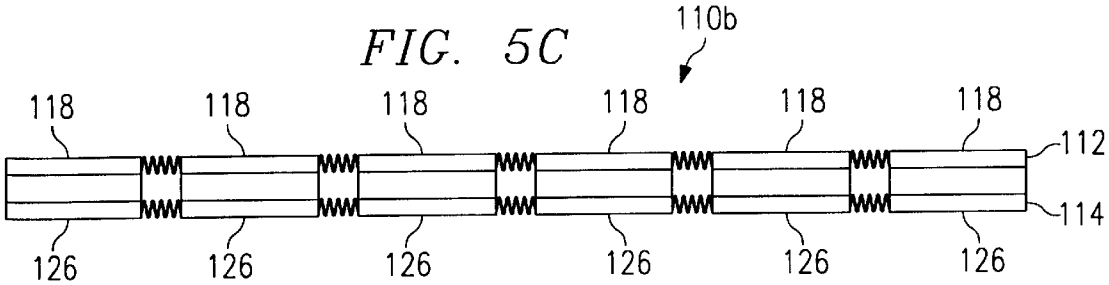

Consequently, as illustrated in FIGS. 5C and 5D, foldable display 110*b* is provided in accordance with the second embodiment of the present invention. Foldable display 110*b* is a version of foldable display 110*a* wherein the clear rigid plates 118 and the rigid plates 126 are structured as a number of relatively narrow strips. Again, for the sake of clarity, some of the layers of anode element 112 and cathode element 114 are not shown.

FIG. 5C is a cross-sectional view of foldable display 110*b* in an unfolded position. For the same amount of operative viewing area, foldable display 110*b* includes a larger number of rigid plates 118 and 126 than foldable display 110*a*.

FIG. 5D is a cross-sectional view of foldable display 110*b* in a rolled up position around a spindle or roll-up bar 68. One end of foldable display 110*b* is attached to the roll-up bar 68. The other end is free so that foldable display 110*b* may be rolled and unrolled.

Figure 6:
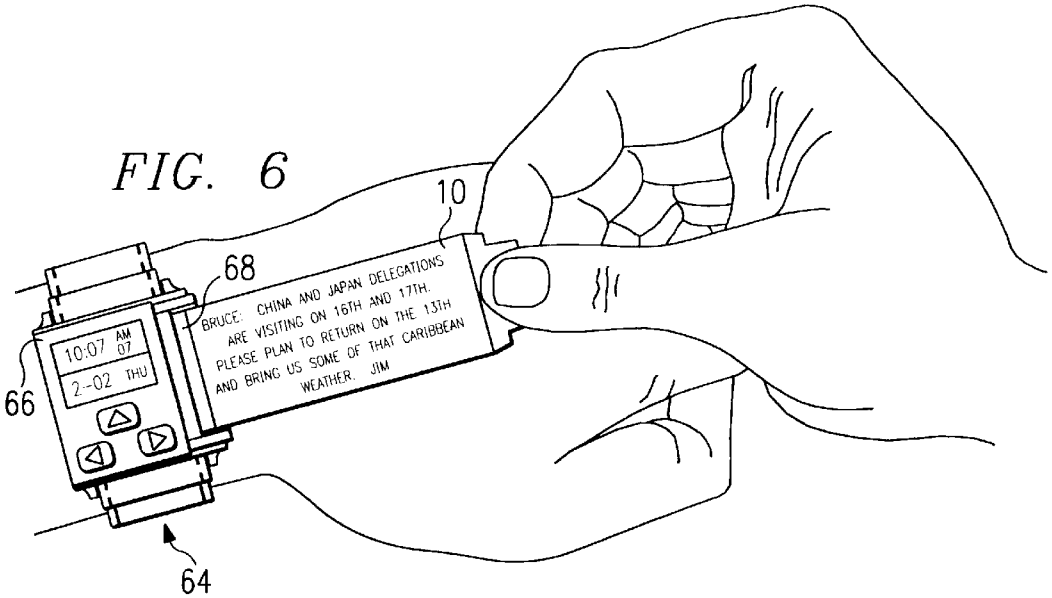
FIG. 6 illustrates an arrangement of a flexible FED display in a wrist-mounted device according to one aspect of the present invention.

FIG. 6 illustrates a wrist-mounted device 64 incorporating a flexible display 10. Wrist-mounted device 64 can include a conventional wrist watch 66 with roll-up bar 68 arranged on one side. Flexible display 10 may be attached to roll-up bar 68. When flexible display 10 is inactive, it can be wound around roll-up bar 68. Then, when flexible display 10 is to be activated, it can be unwound from roll-up bar 68.

Figure 7:
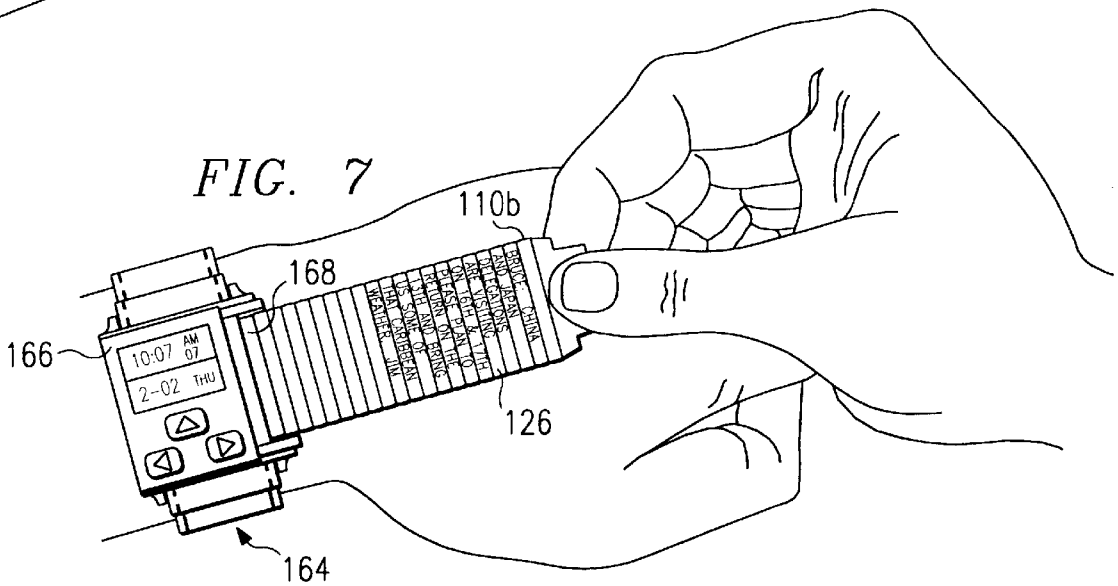
FIG. 7 illustrates an arrangement of a foldable FED display in a wrist-mounted device according to a second aspect of the present invention.

FIG. 7 illustrates a wrist-mounted device 164 incorporating a foldable display 110*b*. The rigid plates 126 are structured as a large number of very narrow strips, so that foldable display 110*b* can be wound around a roll-up bar 168 when the display is inactive. Foldable display 110*b* can be unrolled from roll-up bar 168 when the display is to be activated.

Although the present invention and its advantages have been described in detail, it should be understood that various changes, substitutions, and alterations can be made herein without departing from the spirit and scope of the invention as defined by the appended claims.

What is claimed is:

1. A flexible field emission device display, comprising:

an anode element including a face sheet layer formed from a first layer of flexible insulating substrate material; and a cathode element including a backing sheet layer formed from a second layer of flexible insulating substrate material.

2. The display of claim 1, wherein the first and second layers of flexible insulating substrate material are formed from a polyimide.

3. The display of claim 1, wherein the first and second layers of flexible insulating substrate material are formed of Kapton.

4. The display of claim 1, further comprising a composite matrix embedded in at least one of the face sheet and backing sheet layers.

5. The display of claim 4, wherein the composite matrix is formed from Miramar.

6. The display of claim 1, further comprising a flexible metal film layer attached to the second layer of flexible insulating substrate material.

7. The display of claim 1, further comprising a flexible, non-conductive mesh disposed between the anode and cathode elements.

8. A foldable field emission device display, comprising:

an anode element including a first plurality of rigid plates formed from a rigid insulating substrate material and joined by flexible members formed from a flexible elastomer material; and a cathode element including a second plurality of rigid plates formed from a rigid insulating substrate material and joined by a layer of flexible material.

9. The display of claim 8, wherein the first and second pluralities of rigid plates are structured so that the display can be rolled up.

10. The display of claim 8, wherein the cathode element further comprises a layer of flexible film material joining the second plurality of rigid plates.

11. The display of claim 10, wherein the flexible film material is operable to maintain a vacuum.

12. The display of claim 8, wherein the layer of flexible material is formed from a material selected from a group comprising aluminum, titanium, and tantalum.

13. The display of claim 8, wherein the rigid insulating substrate material is a material selected from a group comprising glass material and rigid polymer.

14. The display of claim 8, wherein the flexible elastomer material is a polymer film.

* * * * *